US009120544B2

(12) United States Patent
Licht

(10) Patent No.: US 9,120,544 B2
(45) Date of Patent: Sep. 1, 2015

(54) DEVICE AND METHOD FOR HAULING IN AN UNMANNED SUBMERSIBLE

(71) Applicant: ATLAS ELEKTRONIK GMBH, Bremen (DE)

(72) Inventor: Joachim Licht, Bremen (DE)

(73) Assignee: ATLAS ELEKTRONIK GMBH, Bremen (DE)

( * ) Notice: Subject to any disclaimer, the term of this patent is extended or adjusted under 35 U.S.C. 154(b) by 0 days.

(21) Appl. No.: 14/366,832

(22) PCT Filed: Dec. 5, 2012

(86) PCT No.: PCT/EP2012/074520
§ 371 (c)(1),
(2) Date: Jun. 19, 2014

(87) PCT Pub. No.: WO2013/092216
PCT Pub. Date: Jun. 27, 2013

(65) Prior Publication Data

US 2014/0331910 A1 Nov. 13, 2014

(30) Foreign Application Priority Data

Dec. 21, 2011 (DE) ..... 10 2011 121 854

(51) Int. Cl.
*B63G 8/00* (2006.01)

(52) U.S. Cl.
CPC ..... *B63G 8/001* (2013.01); *B63G 2008/004* (2013.01); *B63G 2008/008* (2013.01)

(58) Field of Classification Search
CPC ..... B63G 8/00
USPC ..... 114/242, 244, 312, 313, 320, 321, 322
See application file for complete search history.

(56) References Cited

U.S. PATENT DOCUMENTS

| | | | | |
|---|---|---|---|---|
| 7,581,507 | B2 * | 9/2009 | Kern | 114/259 |
| 8,366,162 | B2 * | 2/2013 | Imlach et al. | 294/118 |
| 2001/0020435 | A1 * | 9/2001 | Ghignone | 114/322 |
| 2008/0302292 | A1 * | 12/2008 | Ruggaber | 114/322 |
| 2014/0331910 | A1 * | 11/2014 | Licht | 114/322 |

FOREIGN PATENT DOCUMENTS

| | | | |
|---|---|---|---|
| DE | 19938914 | C1 | 9/2000 |
| WO | 0071415 | A1 | 11/2000 |

OTHER PUBLICATIONS

International Search Report dated Mar. 4, 2013, issued in International Application PCT/EP2012/074520.
Roger Stokey et al., "A Docking System for REMUS, and Autonomous Underwater Vehicle", Oceanographic Systems Laboratory, Department of Applied Ocean Physics and Engineering, IEEE, vol. 2, Oct. 6, 1997, pp. 1132-1136.

* cited by examiner

*Primary Examiner* — Lars A Olson
*Assistant Examiner* — Jovon Hayes
(74) *Attorney, Agent, or Firm* — Fitch, Even, Tabin & Flannery LLP

(57) ABSTRACT

The invention relates to a device and a method for recovering an unmanned underwater vehicle. In order to ensure a safe recovery of an unmanned seconder underwater vehicle 2 by the primary underwater vehicle 1, the invention provides a recovery into a tender garage 4 for receiving the underwater vehicle 2 wherein the underwater vehicle 2 is centered in an entrance area 7 in front of a gate 5 of the tender garage 4 by means of at least one positioning current 8, which is generated outside of the peripheral area of the gate 5 and is oriented toward the entrance area 8. The underwater vehicle 2 is subsequently introduced into the tender garage 4.

14 Claims, 2 Drawing Sheets

DEVICE AND METHOD FOR HAULING IN AN UNMANNED SUBMERSIBLE

CROSS-REFERENCE TO RELATED APPLICATIONS

Figure 1:
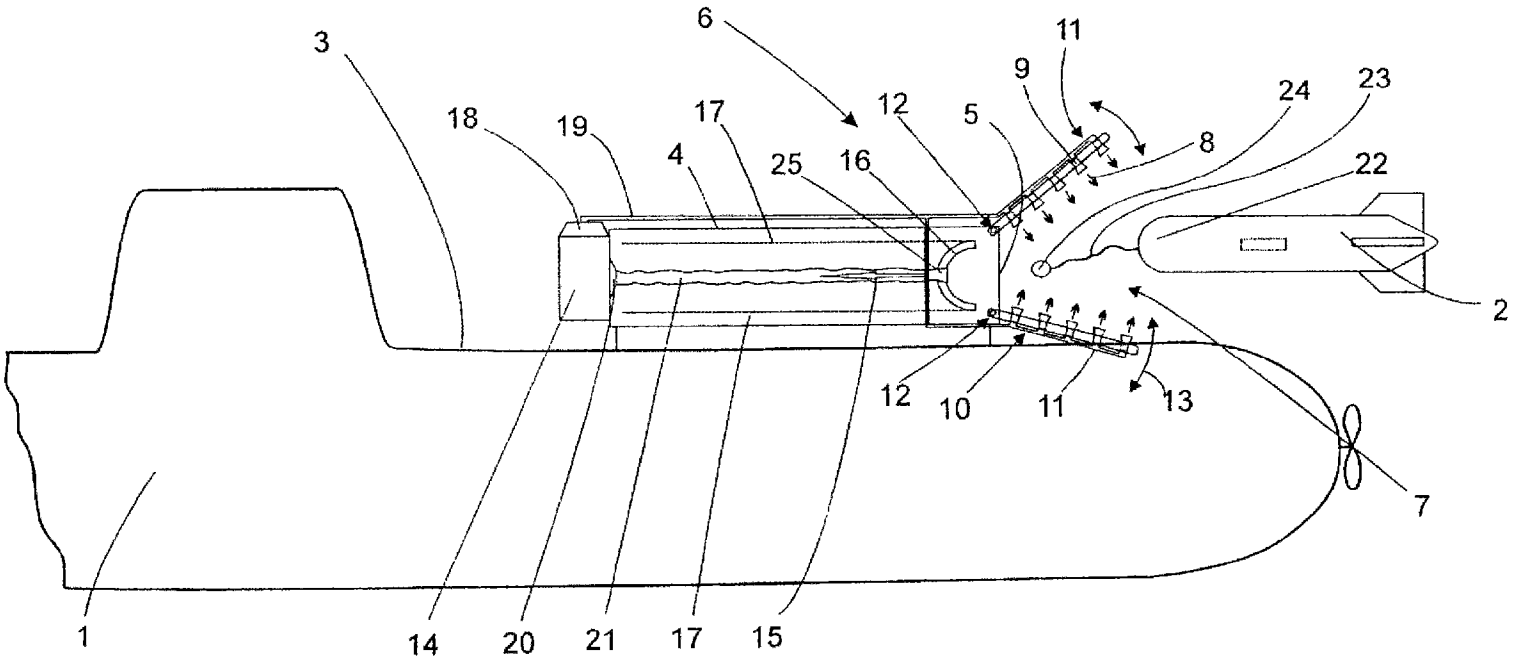

This Application is a U.S. National Stage Application filed under 35 U.S.C. §371 of International Application PCT/EP2012/074520, filed Dec. 5, 2012, designating the United States, which claims priority from German Patent Application 10 2011 121 854.1, filed Dec. 21, 2011, the complete disclosures of which are hereby incorporated herein by reference in their entirety for all purposes.

The invention relates to a device for recovering an unmanned underwater vehicle with a tender garage for receiving the underwater vehicle according to claim 1. The invention moreover relates to a method for recovering an unmanned underwater vehicle into a flooded tender garage according to claim 9.

Unmanned underwater vehicles are used under water for a multitude of tasks, e.g. for searching and surveying the seabed, controlling cables and pipes on the seabed and for salvaging lost equipment. In contrast to manned underwater vehicles, unmanned systems can reach greater working depths and operate in environments that are too dangerous for divers or manned systems. In addition, unmanned systems are used for reconnaissance of sea areas for example for mine clearance and mine destruction, but also for other missions that present too high a risk for manned systems.

Autonomous underwater vehicles (AUV), which fulfill their mission without constant surveillance by human operators and rather follow a predefined mission program, are more specifically adapted for large-scale or extensive underwater reconnaissance and examination of the underwater environment.

Manned underwater vehicles can undertake a safe reconnaissance of a sea area by means of an unmanned underwater vehicle or other missions, for which it is expedient or even necessary to use an unmanned system, if an unmanned secondary underwater vehicle is carried along on board a manned primary underwater vehicle. At the end of the respective mission, the unmanned underwater vehicle must be recovered and stowed away. The recovering maneuver is often difficult because of water movements in the environment of the two involved underwater vehicles and not least because of relative movements between the primary underwater vehicle and the unmanned secondary underwater vehicle. During the recovery and admission of the unmanned secondary underwater vehicle, uncontrolled relative movements can lead to damage to the involved underwater vehicles.

The problem underlying the present invention is to ensure a safe recovery of an unmanned secondary underwater vehicle by the primary underwater vehicle.

According to the invention, the problem is solved by a device for recovering an unmanned underwater vehicle with a tender garage with the features of claim 1. The problem is furthermore solved by a method for recovering an unmanned underwater vehicle in a flooded tender garage with the features of claim 9.

The invention provides a device for recovering an unmanned underwater vehicle with a tender garage for receiving the underwater vehicle and with means for centering the underwater vehicle in an entrance area of the tender garage by way of at least one positioning current. The tender garage is a space enclosed by walls for receiving the secondary underwater vehicle. The tender garage is preferably disposed on the deck of the primary underwater vehicle, in order to carry and protect the secondary vehicle. In order to recover the unmanned underwater vehicle, the underwater vehicle is centered in front of a gate of the tender garage by means of the positioning current(s), which are generated outside of the peripheral area of the gate and are oriented toward the entrance area, preferably in the direction of an axis located in the center of the entrance area. Specific flow conditions are thereby generated in the entrance area of the tender garage by inducing positioning currents, which act in a centering manner on the boat body of the incoming unmanned watercraft.

As a means for centering the underwater vehicle, the device for recovering the unmanned underwater vehicle includes one or several positioning nozzles, by way of which a positioning current is delivered in the entrance area by means of pump devices. After centering the underwater vehicle in the entrance area by means of the positioning current, the unmanned underwater vehicle is safely introduced into the tender garage and collisions with the walls of the tender garage are thus avoided.

Once the unmanned underwater vehicle has been centered in the entrance area in front of the gate of the tender garage, the unmanned underwater vehicle is driven into the tender garage by means of its own drive or pulled into the interior of the tender garage by means of a receiving device disposed in the tender garage.

It is advantageous if several positioning nozzles are provided for generating positioning currents. The device for recovering the unmanned underwater vehicle includes a pump device to which the positioning nozzles are connected and by which the positioning nozzles are supplied in order to generate the positioning currents. The positioning nozzles are respectively located in the mantle area of a funnel that expands in the entrance area. To this end, a structure is provided which carries the positioning nozzles in such a manner that the positioning currents are generated in the mantle area of a funnel.

The funnel-shaped arrangement of the positioning nozzles and the individual positioning currents emitted by the positioning nozzles increasingly lead the unmanned underwater vehicle, which approaches the bottom of the funnel of the positioning nozzles during recovery in the tender garage, into the desired central position in front of the gate of the tender garage. As the proximity to the tender garage increases, the funnel closes, so that the positioning nozzles are located in an increasing proximity to the boat body and correspondingly exert stronger fluid dynamic forces on the boat body.

In an advantageous embodiment of the invention, the positioning nozzles are disposed on a funnel-shaped nozzle holder, which is fastened to the tender housing. By being fastened on the nozzle holder, the positioning nozzles are thereby always held in an optimal position for centering the unmanned underwater vehicle, wherein the positioning currents originate in places that are located in the mantle of the funnel. In an advantageous embodiment of the invention, the nozzle holder is a circumferential component that is mounted on the gate of the tender garage.

In a preferred embodiment of the invention, the nozzle holder includes two or several nozzle arms mounted in a pivotable manner on the outside of the tender garage and which carry a row of positioning nozzles. When initiating of a recovery maneuver the nozzle arms are pivoted into a maneuvering position, in which the nozzle arms are located in the mantle area of the funnel and thus bring the positioning nozzles into an optimal position for the desired centering of the underwater vehicle to be recovered. The positioning nozzles are advantageously disposed on the nozzle arms at respectively equal intervals, so that groups of positioning nozzles are positioned on the nozzle arms at about the same level in the funnel. These positioning nozzles, which are located at the same level, act onto the boat body between the positioning nozzles with their respective positioning currents, which originate from different directions, so that the underwater vehicle is centered.

The nozzle arms are advantageously disposed in substantially equal intervals between each other on the circumference of the gate of the tender garage, in order to achieve a centering effect that is as homogeneous as possible through the interaction of the positioning nozzles.

After completion of the recovery maneuver, when the unmanned underwater vehicle is secured in the tender garage, the nozzle arms are pivoted from their maneuvering position into a resting position, in order to reduce the hydrodynamic resistance of the device for recovering the unmanned underwater vehicle. In their resting position the nozzle arms are brought in an overlapping position on the gate of the tender garage or rest on the outside of the tender garage.

As a tool for recovery of the unmanned underwater vehicle, a receiving head, on which the underwater vehicle can be docked, is disposed in the tender garage in a longitudinally movable manner. During recovery of the underwater vehicle, the receiving head is positioned in the area of the gate, the positioning nozzles and the positioning currents generated by these positioning nozzles being adjusted to the position of the receiving head in such a manner that the underwater vehicle is centered level with the receiving head by the positioning currents. After the underwater vehicle has been centered, the bow of the underwater vehicle is introduced through the gate and docked on the receiving head. The receiving head advantageously comprises tools for seizing the underwater vehicle, respectively recovery means, which are fastened on the underwater vehicle for the purpose of carrying out the recovery maneuver.

In a preferred embodiment of the invention, the device for recovering the unmanned underwater vehicle comprises a suction pump, which is disposed—preferably on the tender garage—in such a manner that a suction current is generated in the tender garage in the intended direction of introduction of the underwater vehicle. The suction current thereby supports the recovery underwater vehicle into the tender garage. The suction pump is particularly preferably connected on its pressure side to the positioning nozzles in such a manner that the suction current can be fed back out of the interior space of the tender garage into the entrance area of the tender garage for generating the positioning currents. Here, only a part of the suction current is advantageously fed back into the entrance area for generating the positioning currents, thus increasing the centering effect of the positioning currents. For continuity reasons the suction current in the tender garage also forms a current in the entrance area of the tender garage. Thus, the suction current acts in the center of the funnel formed by the positioning currents, an increased effectiveness being achieved through the combination of the suction current in the center and of the positioning currents in the mantle area of the funnel.

The suction side of the suction pump is advantageously connected to the longitudinally movably disposed receiving head in such a manner that the suction current is producible via the receiving head. If the suction current is generated via the receiving head, the unmanned underwater vehicle is pulled directly toward the receiving head by the suction current during the recovery maneuver.

After the first step of centering the unmanned underwater vehicle, the underwater vehicle is introduced into the tender garage in a second step of the recovery maneuver. In an advantageous embodiment of the invention, the receiving head is configured to receive a recovery rope disposed on the bow of the underwater vehicle, wherein the underwater vehicle can be pulled into the interior of the vehicle via the recovery rope by retracting the receiving head. The recovery rope is conveyed directly to the receiving head by the suction current generated by the receiving head. As soon as the receiving head has received the recovery rope, the underwater vehicle can be hauled into the tender garage by pulling in the recovery rope.

A preferably neutrally buoyant floating body, which is pulled by the suction current into the interior of the tender garage due to its hydrodynamic resistance thereby entraining the recovery rope, is advantageously disposed at the free end of the recovery rope at the bow of the underwater vehicle. Here, the neutrally buoyant floating body can be a ball, which closes the mouth of a suction pipe impinged by the suction pump upon reaching the receiving head so that the suction effect decreases after the underwater vehicle has been centered. The subsequent introduction, respectively recovery of the centered underwater vehicle into the tender garage can thereby occur independently from flow-dynamic effects. In addition, disposing a ball-shaped floating body at the free end of the recovery rope is advantageous in that the floating body can easily be held by corresponding gripping means in the device for recovering the unmanned underwater vehicle.

In another advantageous embodiment of the invention, the tender garage is configured to receive one or several torpedoes. The torpedoes or other underwater bodies to be launched as required during travel of the primary underwater vehicle can be sheltered and carried along in the tender garage. This is more specifically advantageous during missions of the manned underwater vehicle without a scheduled deployment of the AUV.

Other features of the invention can be gathered from the dependent claims and from the exemplary embodiments, which are described in more detail in the following based on the drawings.

Figure 2:
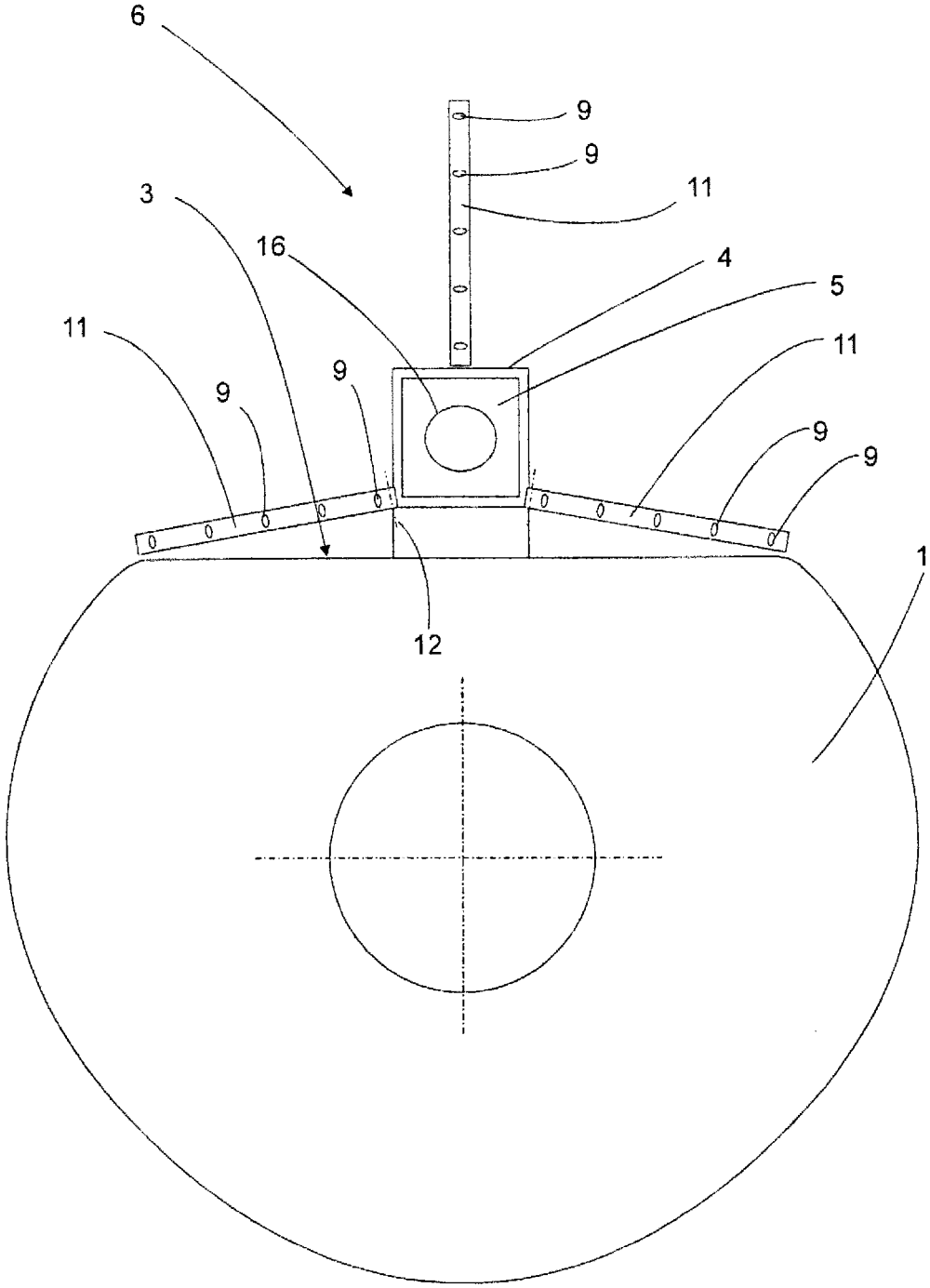

FIG. 1 shows a schematic lateral view of an underwater vehicle with a device for recovery of an unmanned secondary underwater vehicle and FIG. 2 shows a top view onto the entrance area of the device for recovery of an unmanned secondary underwater vehicle according to FIG. 1.

FIG. 1 shows the rear part of a manned underwater vehicle 1 or U-boat, which, as a primary vehicle, carries along an unmanned underwater vehicle 2. The unmanned underwater vehicle 2 is an autonomous underwater vehicle and is launched by the primary vehicle as required, for example for reconnaissance of a sea area or other missions, and is recovered after completion of the mission. In order to receive the unmanned underwater vehicle 2, a tender garage 4 is disposed on the deck 3 of the unmanned underwater vehicle 1. The tender garage 4 is a container closed by walls, which can be opened by a gate 5 to allow passage of the underwater vehicle 2.

FIG. 2 shows a top view onto the stern of the manned underwater vehicle 1 with the tender garage 4 for the unmanned secondary underwater vehicle 2 disposed on the deck 3. In the figures, the same reference numbers are respectively used for the same components.

The tender garage 4 is disposed on the deck 3 in such a manner that the gate 5 points toward the stern. The secondary underwater vehicle 2 thus approaches the tender garage from astern, making it easier to haul in, respectively dock, the secondary underwater vehicle 2 when the primary underwater vehicle 1 is travelling.

The tender garage 4 is part of a device 6 for recovering the unmanned underwater vehicle 2, which includes means for centering the underwater vehicle 2 in an entrance area 7 in front of the gate 5 of the tender garage 4, which are described in more detail in the following. During a recovery maneuver, the underwater vehicle is centered in front of the gate 5 while approaching the tender garage and positioned for a subsequent entry into the tender garage 4 by means of positioning currents 8. The positioning currents 8 are respectively generated by a positioning nozzle 9 outside of the peripheral area of the gate 5 and are oriented radially relative to the center of the entrance area 7 of the tender garage 5. The positioning nozzles 9 are disposed in such a manner that they are respectively located in the mantle of a funnel widening in the entrance area 7. To this end, the positioning nozzles 9 are disposed on a funnel-shaped nozzle holder 10 fastened to the tender garage 4.

The nozzle holder 10 includes three nozzle arms 11 mounted in a pivotable manner on the tender garage 4, which respectively carry a row of positioning nozzles 9. The nozzle arms 11 are substantially disposed on the circumference of the gate 5 of the tender garage 4 in star-shaped manner, i.e. at intervals that are as similar as possible. The nozzle arms 11 are fastened to the tender garage 4 so as to be rotatable about a swivel axis 12 and are brought into a maneuvering position for implementing the recovery maneuver, in which the nozzle arms 11 are located in the mantle area of a funnel widening in the entrance area 7 of the tender garage 4. The underwater vehicle 2 is centered in this funnel formed by positioning currents 8, since the positioning currents 8 prevent the underwater vehicle from drifting in the direction of the funnel mantle.

In the present exemplary embodiment the nozzle holder 10 includes three nozzle arms 11 disposed in an approximately star-shaped manner (FIG. 2). Once the unmanned underwater vehicle 2 has entered the tender garage 4, the nozzle arms 11 are pivoted into a rest position in which a flow resistance is given that is as low as possible. To this end, the nozzle arms 11 are either pivoted in the direction of the arrow 13 into the section of the entrance area 7 overlapping the gate 5 or pivoted in the opposite direction and come to rest on the outside of the tender garage 4.

In the tender garage 4, a suction current, which acts in the intended direction of introduction 15 of the underwater vehicle 2 into the tender garage 4, is generated by means of a suction pump 14. The suction current continues to act in the direction of introduction 15 beyond the opened gate 5 in the entrance area 7 of the tender garage 4 and contributes to centering the underwater vehicle 2 and to the introduction into the tender garage 4.

In addition, a receiving head 16, on which the unmanned underwater vehicle 2 is dockable, is disposed in the tender garage 4 in a longitudinally movable manner. As soon as the underwater vehicle 2 has been guided into the area of the receiving head 16, the underwater vehicle 2 is docked on the receiving head. During this docking maneuver, the docked underwater vehicle 2 is held so that it rests on the receiving head and is then pulled into the tender garage 4 in a guided manner by the receiving head 16. The receiving head 16 is guided in a longitudinally movable manner in the tender garage 4 by way of appropriate guiding means, e.g. rails 17. In the maneuvering position, the receiving head 16 is located close to the gate 5 and, once the underwater vehicle 2 has docked, is moved into the interior of the tender garage 4 by way of the rails 17. The bow of the underwater vehicle is received by the receiving head in a positive fit, the underwater vehicle moving under its own power into the tender garage 4 and thus pushing back the receiving head 16.

Gripping means, which seize the underwater vehicle 2 after docking on the receiving head 16, can be alternately or additionally provided on the receiving head 16. The underwater vehicle 2 is subsequently pulled by drive means acting on the receiving head 16 and not under its own drive into the interior of the tender garage 4.

The suction pump 14 is connected on its pressure side 18 to the positioning nozzles 9 via a recirculation pipe 19. That way, the suction pump 14 of the device 6 for recovery of the unmanned underwater vehicle 2 can generate the suction current in the direction of introduction 15 as well as the positioning currents 8. The positioning nozzles 9 are connected to the suction pump 14 in such a manner that the suction current is partially fed back into the entrance area 7 in order to generate the positioning currents 9. By partially feeding back the aspirated mass flow the centering effect in the entrance area 7 of the tender garage 4 is increased, due to a strong central suction current acting on the underwater vehicle 2 in the direction of introduction 15.

A suction side 20 of the suction pump 14 is connected to the receiving head 16 in such a manner that the section current is generated via the receiving head 16. Thus, at the start of the recovery maneuver, when the receiving head 16 is located close to the gate 5, a strong suction current is generated in the entrance area 7 of the tender garage 4 and the underwater vehicle is aspirated. The suction pump 14 is connected to the receiving head 16 by way of a flexible connection, namely a suction pipe 21. The flexible suction pipe 21 allows the guided longitudinal movement of the receiving head 16. The suction pipe 21 is designed to be expandable and flexible, e.g. as a pleated bellows.

The receiving head 16 is designed to receive a recovery rope 23 disposed at the bow 22 of the unmanned underwater vehicle 2. While the underwater vehicle 2 is being centered by the positioning currents, the recovery rope 23 is simultaneously aspirated by the suction current into the interior of the tender garage 4 in the direction of introduction 15. It is possible to pull the underwater vehicle 2 into the tender garage 4 by way of the recovery rope 23.

A ball-shaped floating body 24 is disposed at the free end of the recovery rope 23. The floating body 24 is pulled by the suction current toward the receiving head 16 due to its flow resistance and thereby entrains the recovery rope 23. In order to encourage the aspiration of the floating body 24, the floating body 24 is designed so as to be as neutrally buoyant as possible.

The ball-shaped floating body 24 has a size that is sufficient to seal off an outlet 25 of the suction pipe 21 on the receiving head 16. As soon as the ball-shaped floating body 24 has reached the receiving head 16, respectively the outlet 25 of the suction pipe 21, the mass flow conveyed by the suction pump 14 is reduced. The underwater vehicle 2, which has already been centered at the time of closing of the outlet 25, can thereby be more easily introduced into the tender garage 4 in a subsequent step of recovering the underwater vehicle 2.

The length of the recovery rope 23 with the floating body 24 disposed on it is adapted to the opening angle of the nozzle holder 10 in order to ensure that, at the time of closing of the outlet 25 of the suction pipe 21, the underwater vehicle 2 has already been brought so close to the tender garage 4 that it is optimally centered and positioned in the entrance area 7 of the tender garage 4 by the positioning currents 8.

All he features mentioned in the above description and in the claims are usable individually or in any combination of each other. The disclosure of the invention is therefore not limited to the described, respectively claimed combination of features. In fact, all combinations of the features are to be considered as disclosed.

The invention claimed is:

1. A device for recovering an unmanned underwater vehicle (2) with a tender garage (4) for receiving the underwater vehicle (2) and with means for centering the underwater vehicle (2) in an entrance area (7) in front of a gate (5) of the tender garage (4) by means of at least one positioning current (8), which is generatable by these means outside of the peripheral area of the gate (5) and is oriented toward the entrance area (7).

2. The device according to claim 1, wherein that the means for centering the underwater vehicle (2) in an entrance area (7) in front of a gate (5) of the tender garage (4) include several positioning nozzles (9) for generating positioning currents (8), which are disposed in such a manner that they are located in the mantle of a funnel widening in the entrance area (7).

3. The device according to claim 1, wherein the positioning nozzles (9) are disposed in a nozzle holder (10) fastened to the tender garage (4), the nozzle holder (10) including two or more nozzle arms (11) mounted in a pivotable manner on the tender garage (4) and which respectively carry a row of positioning nozzles (9).

4. The device according to claim 1, wherein a receiving head (16), onto which the unmanned underwater vehicle (2) is dockable, is disposed in the tender garage (4) so as to be longitudinally movable.

5. The device according to claim 1, wherein the tender garage (4) includes a suction pump (14), which is disposed in such a manner that a suction current is generated in the intended direction of introduction (15) of the underwater vehicle (2) into the tender garage (4), the suction pump (14) being connected on its pressure side (17) to the positioning nozzles (9), the suction pump (14) and the positioning nozzles (9) being connected to each other in such a manner that the suction current is partially recirculatable into the entrance area (7) for generating the positioning currents (8).

6. The device according to claim 5, wherein a suction side (20) of the suction pump (14) is connected to the receiving head (16) in such a manner that the suction current is generatable by way of the receiving head (16).

7. The device according to claim 3, wherein a recovery rope (23) to be arranged at the bow (22) of the unmanned underwater vehicle (2), the receiving head (16) being configured to receive the recovery rope (23) or a floating body (24) disposed on the recovery rope (23).

8. The device according to claim 1, wherein the tender garage (4) is configured to receive torpedoes.

9. A method for recovering an unmanned underwater vehicle (2) in a flooded tender garage (4), the underwater vehicle (2) being centered in an entrance area (7) in front of a gate (5) of the tender garage (4) by means of at least one positioning current (8), which is generated outside of the peripheral area of the gate (5) and is oriented toward the entrance area (7), and the underwater vehicle (2) being subsequently introduced into the tender garage (4).

10. The method according to claim 9, wherein that several positioning currents (8) are emitted in the mantle area of a funnel widening in the entrance area (7) of the tender garage (4).

11. The method according to claim 9, wherein the underwater vehicle (2) is docked on a receiving head (16) disposed in the tender garage (4) so as to be longitudinally movable and is guided with the receiving head (16) into the interior of the tender garage (4).

12. The method according to claim 11, wherein a suction current is generated by means of a suction pump (14) in the tender garage (4) in the direction of introduction (15) of the underwater vehicle (2), the suction current being partially fed back into the entrance area (7) for generating the positioning currents (8).

13. The method according to claim 12, wherein the suction pump (14) generates the suction current by way of the receiving head (16).

14. The method according to claim 9, wherein a recovery rope (23) fastened to the bow (22) of unmanned underwater vehicle (2) or a floating body (24) disposed on the recovery rope (23) is aspirated into the tender garage (4) and the underwater vehicle (2) is subsequently pulled by means of the recovery rope (23) into the tender garage (4).

* * * * *